United States Patent [19]

Jogwick

[11] 3,974,056

[45] Aug. 10, 1976

[54] ELECTROPLATING SELECTED PORTIONS OF A STRIP

[75] Inventor: Kurt W. Jogwick, Livonia, Mich.

[73] Assignee: Ann Arbor Circuits, Inc., Ann Arbor, Mich.

[22] Filed: May 23, 1975

[21] Appl. No.: 580,489

[52] U.S. Cl. ..... 204/207; 204/15; 204/28; 204/206; 204/224 R; 204/285; 204/297 R

[51] Int. Cl.[2] ..... C25D 5/02; C25D 5/04; C25D 7/06

[58] Field of Search ..... 204/206, 224 R, 207, 204/15, 28, 17, 211, 28, 297 R, 285

[56] References Cited

UNITED STATES PATENTS

| | | | |
|---|---|---|---|
| 2,378,002 | 6/1945 | Drummond et al. | 204/206 |
| 3,535,222 | 10/1970 | Cooke et al. | 204/211 X |
| 3,630,864 | 12/1971 | Nakamura et al. | 204/211 X |
| 3,819,502 | 6/1974 | Meuldijk et al. | 204/15 X |
| 3,860,499 | 1/1975 | Graham et al. | 204/224 R X |
| 3,878,062 | 4/1975 | Grimaldi et al. | 204/224 R X |

*Primary Examiner*—John H. Mack
*Assistant Examiner*—A. C. Prescott
*Attorney, Agent, or Firm*—Barnes, Kisselle, Raisch & Choate

[57] ABSTRACT

An apparatus for electroplating selected portions of a strip comprises means for intermittently moving the strip through successive stations. Means are provided at one of the stations for selectively electroplating selected portions of the strip and comprises upper and lower press members which are movable relatively toward and away from one another. An upper mask of resilient material is provided on the upper member and a lower mask of resilient material is provided on the lower member. The lower mask has a plurality of openings therein having the configuration of the selected portion which is to be plated. When the upper and lower members are moved toward one another, the strip is gripped. The lower member has a plurality of openings therein. The openings in the lower member have their lower ends chamfered and extend to a first chamber in the lower member. A plurality of tubes are mounted in said first chamber and have their upper ends extending into the chamfered portions of the openings in the lower member. The lower member has a second chamber and an inlet to the second chamber. The second chamber communicates with the interior of the tubes such that electroplating solution may be passed through the inlet to the second chamber and, in turn, through each of the tubes to direct electroplating solution against the underside of the exposed selected portions of the strip, the solution thereafter passing along the chamfered portions to the first chamber and to an outlet from the first chamber.

19 Claims, 18 Drawing Figures

ELECTROPLATING SELECTED PORTIONS OF A STRIP

This invention relates to electroplating selected portions of a strip.

BACKGROUND OF THE INVENTION

In electronic materials and the like, it is common to utilize frames or segments of a metallic strip which have portions thereof removed and other portions thereof selectively plated with an appropriate metal, such as gold, to serve as a base for application of selected electronic components thereon.

Among the objects of the invention are to provide a method and apparatus for electroplating selected portions of a strip before the strip is severed to form frames; wherein the electroplating is achieved with efficiency and minimal waste; wherein the apparatus includes novel electroplating means; wherein the apparatus includes novel means for treating the strip before and after electroplating; and wherein the apparatus can be readily adapted to change the configuration of the selected portions which are being plated.

SUMMARY OF THE INVENTION

An apparatus for electroplating selected portions of a strip comprises means for intermittently moving the strip through successive stations. Means are provided at one of the stations for selectively electroplating selected portions of the strip and comprises upper and lower press members which are movable relatively toward and away from one another. An upper mask of resilient material is provided on the upper member and a lower mask of resilient material is provided on the lower member. The lower mask has a plurality of openings therein having the configuration of the selected portion which is to be plated. When the upper and lower members are moved toward one another, the strip is gripped. The lower member has a plurality of openings therein. The openings in the lower member have their lower ends chamfered and extend to a first chamber in the lower member. A plurality of tubes are mounted in said first chamber and have their upper ends extending into the chamfered portions of the openings in the lower member. The lower member has a second chamber and an inlet to the second chamber. The second chamber communicates with the interior of the tubes such that electroplating solution may be passed through the inlet to the second chamber and, in turn, through each of the tubes to direct electroplating solution against the underside of the exposed selected portions of the strip, the solution thereafter passing along the chamfered portions to the first chamber and to an outlet from the first chamber.

DESCRIPTION

Figure 7:
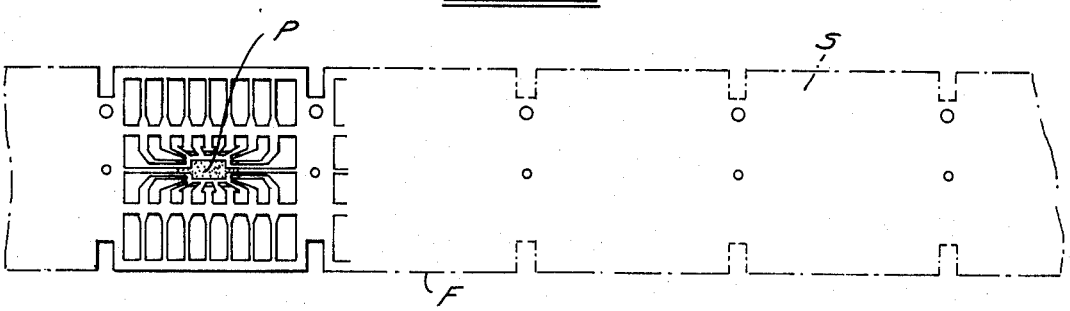
FIG. 7 is a fragmentary plan view on an enlarged scale of a portion of a typical strip which may be plated in accordance with the apparatus.

Referring to FIG. 7, the invention relates to the plating of selected portions P of a strip S that comprises a plurality of frames F, each of which has portions thereof cut away as by stamping to define segments that may be utilized as conductive leads in the assembly of electronic components on each frame F. In order to minimize waste, only a portion P of each strip is to be plated. The strip includes openings O which may be utilized for purposes of registry as presently described.

Figure 1:
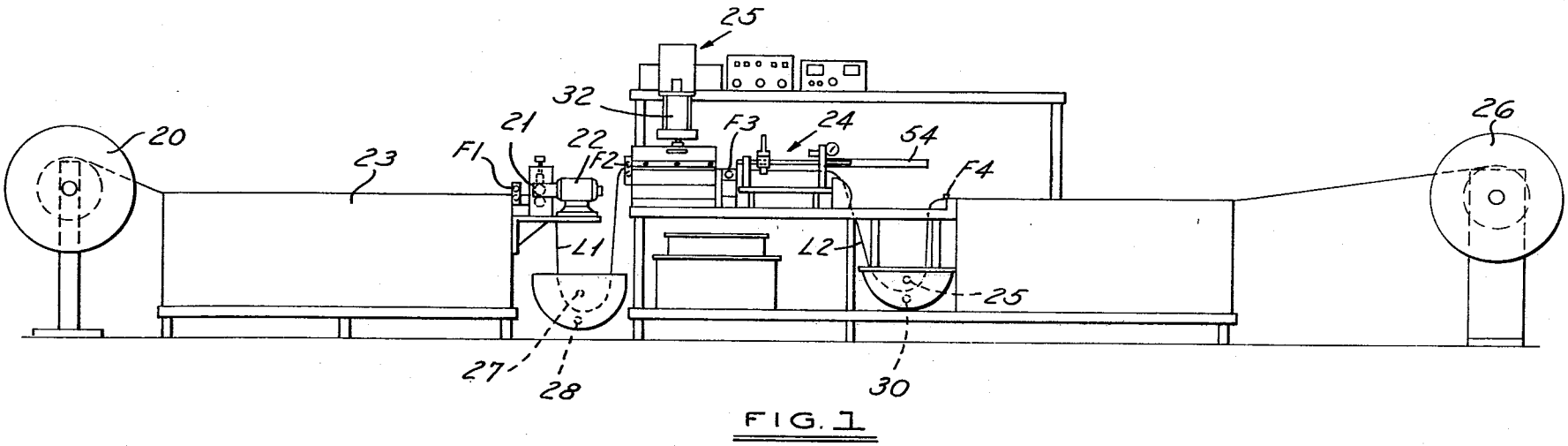
FIG. 1 is a partly diagrammatic side elevational view of an apparatus embodying the invention.
Figure 2:
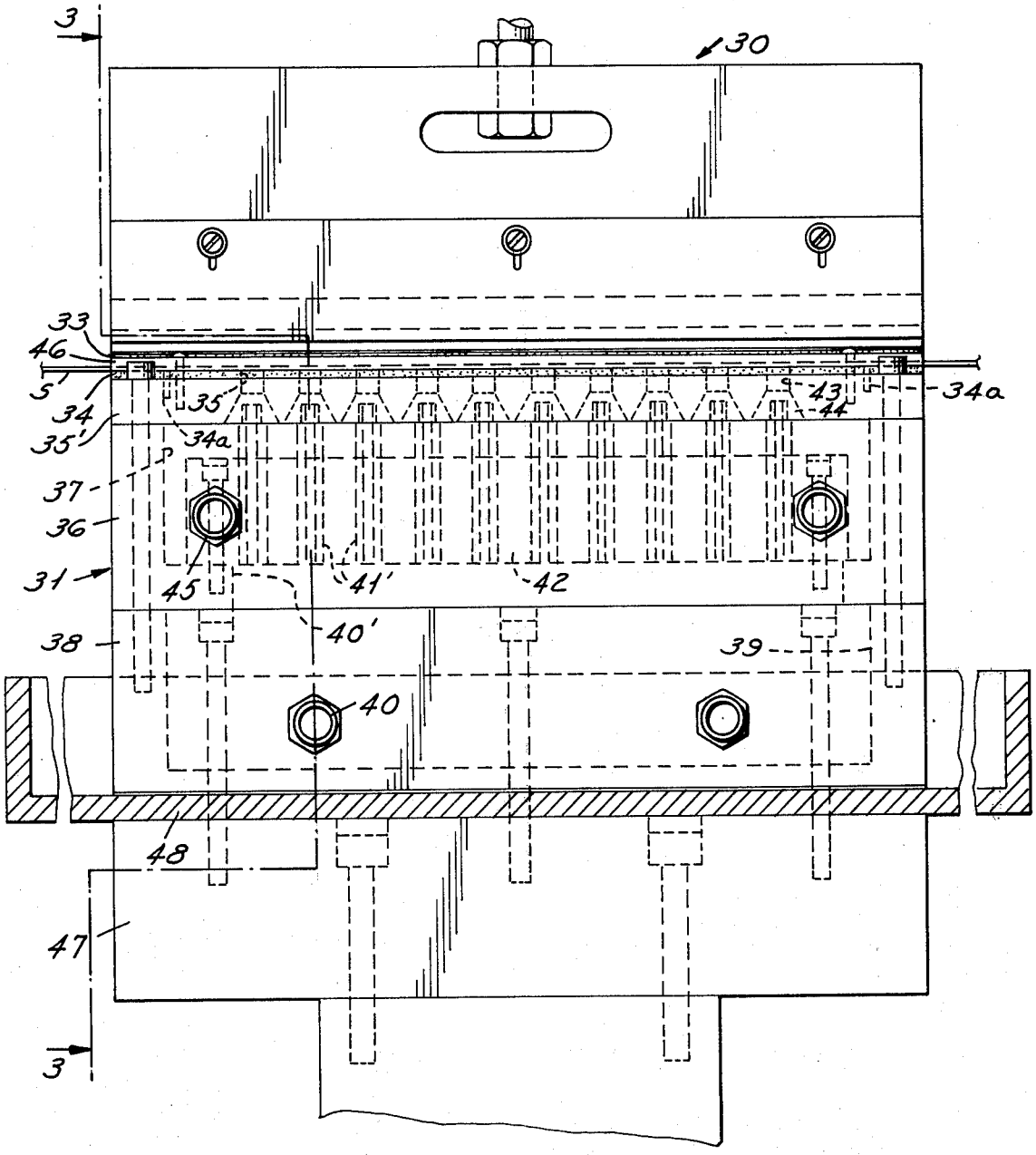
FIG. 2 is a part sectional elevational view on an enlarged scale of a portion of the apparatus shown in FIG. 1.
Figure 3:
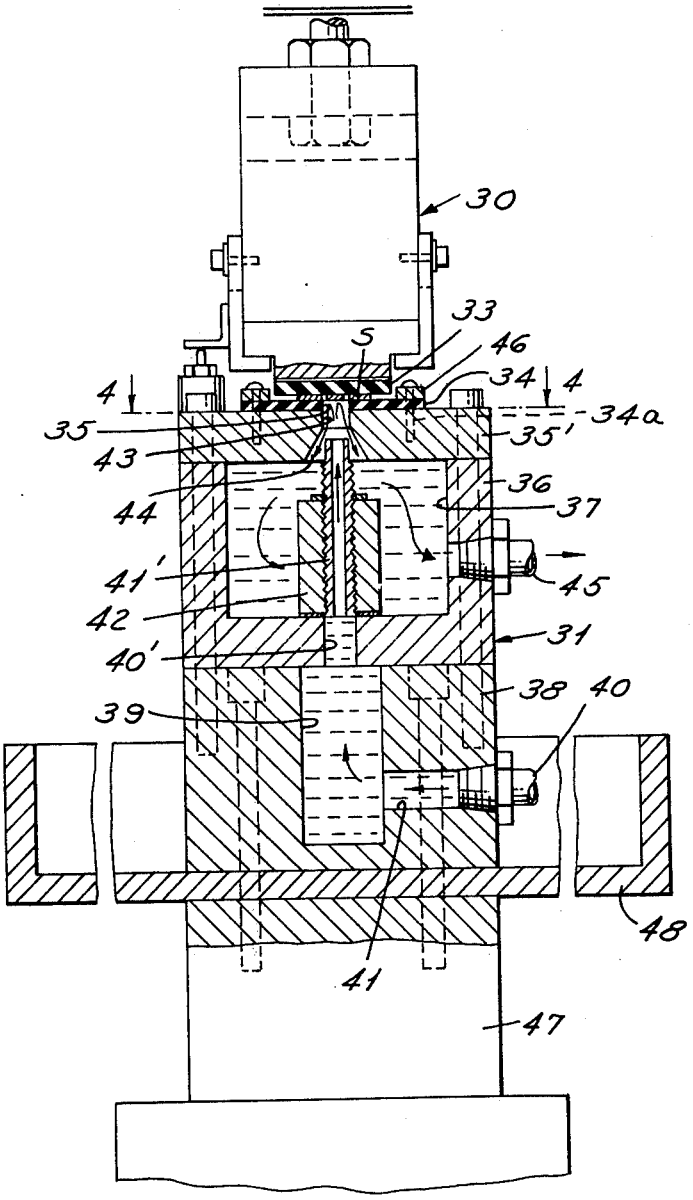
FIG. 3 is a sectional view taken along the line 3—3 in FIG. 2.
Figure 4:
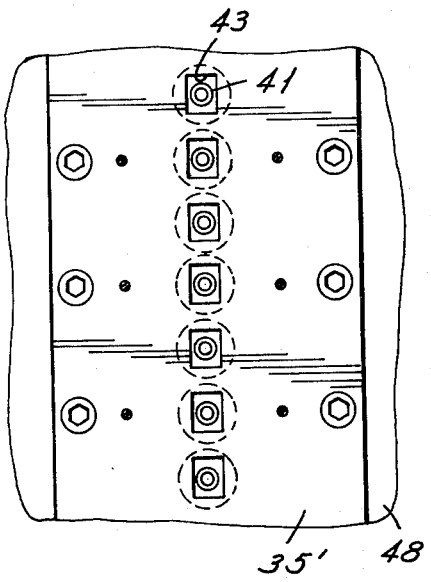
FIG. 4 is a fragmentary sectional view taken along the line 4—4 in FIG. 3.
Figure 5:
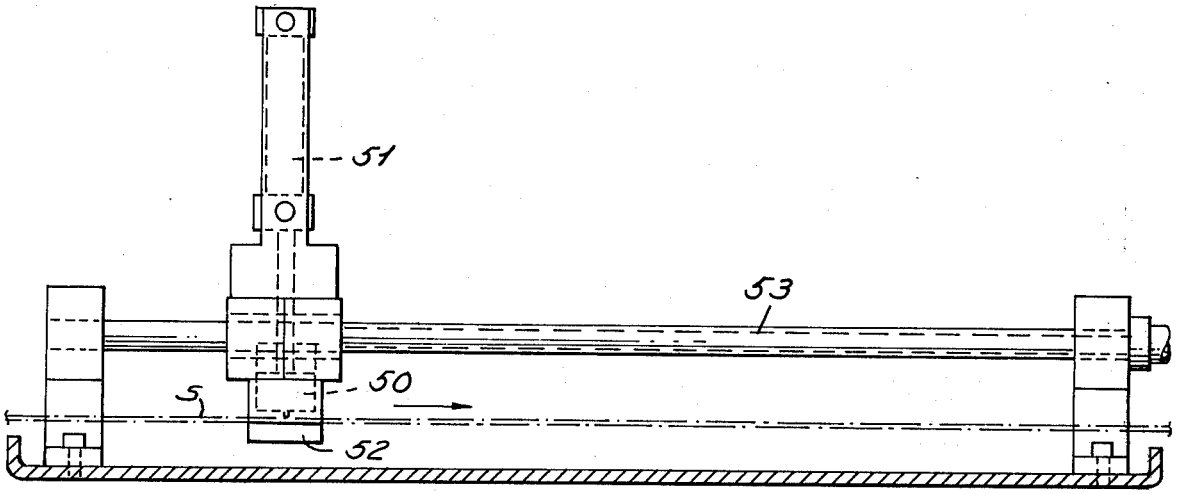
FIG. 5 is a part sectional longitudinal view on an enlarged scale of a portion of the apparatus shown in FIG. 1.
Figure 6:
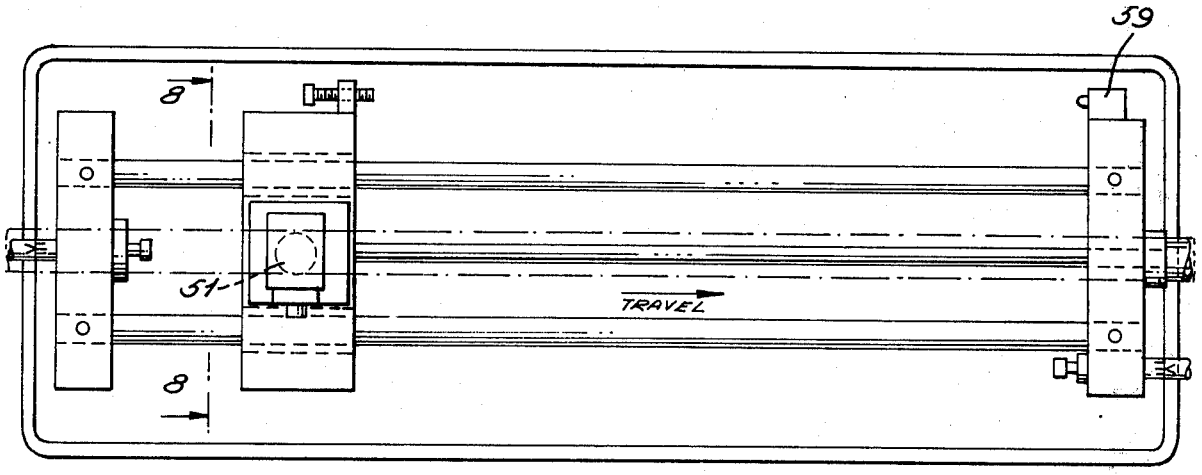
FIG. 6 is a fragmentary plan view of a portion of the apparatus shown in FIG. 5.

Referring to FIG. 1, the apparatus comprises a supply reel 20 on which the strip S is initially wound. A pair of drive rollers 21 driven by a motor 22 draws the strip from the supply reel 20 through one or more solution tanks 23 as may be required for the particular kind of plating. An intermittently driven gripping means 24 pulls the strip through a station at which a plating apparatus 25 is positioned. A loop L1 is provided in the strip in advance of the plating station 25 and beyond the gripping and feeding apparatus 24. The strip then passes to a take-up reel 26. The motor 22 is controlled by sensors 27, 28 associated with the loop L1. Similar sensors 29, 30 are associated with the loop L2 to control the motor driving the take-up reel 26.

The apparatus at the plating station comprises an upper head or chamber 30 which is moved toward and away from a lower head 31 by a cylinder 32. The upper head 30 supports a flat resilient mask 33 which is adhered thereto and may be made of a material such as trifluorethylene, gum rubber, urethane or the like.

Lower member 31 supports a mask 34 made of similar material and having openings 35 which have a configuration corresponding to the configuration of the selected portions of the strip which are to be plated.

The lower member 31 comprises a plate 35, a first body 36 having a first chamber 37 therein, and a second body 38 having a second pressure equalizing chamber 39 therein.

An inlet 40 supplies electroplating solution through an opening 41 into the second chamber 39 and thereafter through an elongated slot 40 in the base of block 36 upwardly into a plurality of tubes 41 that are threaded into a distributor block 42. The tubes 41 direct the electroplating solution upwardly into openings 43 in the plates 35 which are aligned with the openings 35 in the mask 34. The lower end of each opening 43 is chamfered as to 44. The electroplating solution moving upwardly through the tubes 41 strikes the area of the strip S which is to be plated and thereafter flows outwardly as shown by the arrows into the first chamber 37 and then through an outlet 45.

The mask 34 is retained by a retaining frame 46 and is held in place by registration pins 34*a*, one at each end of the mask. The lower member 31 is mounted on a base 47. A tray 48 is interposed between the lower block 38 and the base 47 to provide a collecting tank for any fluid or solution that may flow outwardly.

The blocks 36, 42 and tubes 41 are preferably made of electrically conducted material such as titanium so that an electrical circuit can be made through these parts and the solution to the strip S which is grounded through one of the friction rollers, as presently described. Alternatively, these parts may be made of plastic and a circuit to the solution provided by electrically conductive bolts holding the parts together.

By replacing the plate 35 with a plate having openings of different configuration, the area and shape of the selected portions of the strip S which are to be plated can be readily changed. The tubes 41 are movable axially by threading into and out of the distributor block to provide an accurate or fine control of the anode to cathode ratio, the cathode being the strip to be plated.

By providing chamfered portions 44, the upper ends of tubes 41 can be positioned in close proximity to the openings 35 in mask 34 without restricting the return or back wash of solution that has already been in contact with the portion of the strip S being plated.

Figure 8:
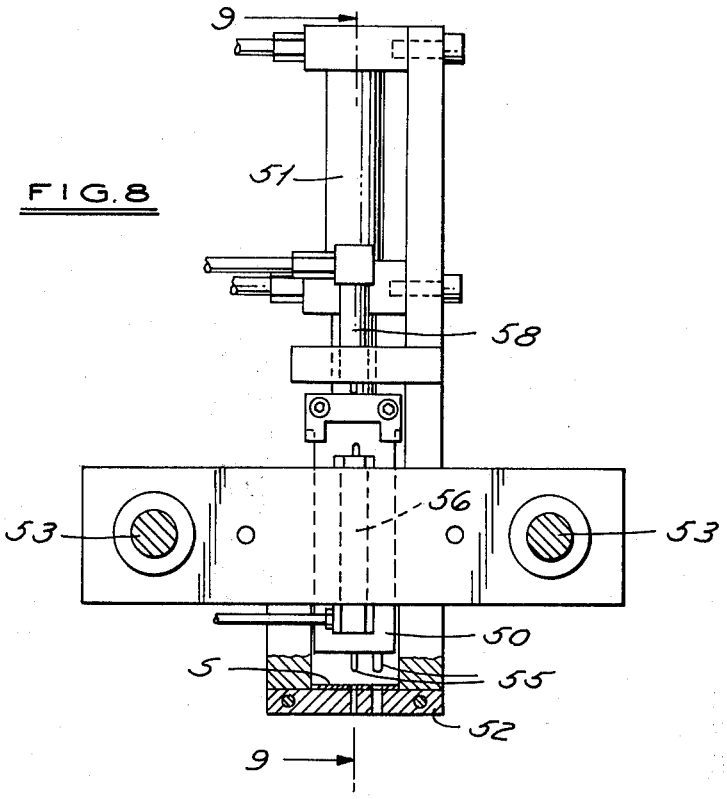
FIG. 8 is a fragmentary sectional view taken along the line 8—8 in FIG. 6.
Figure 9:
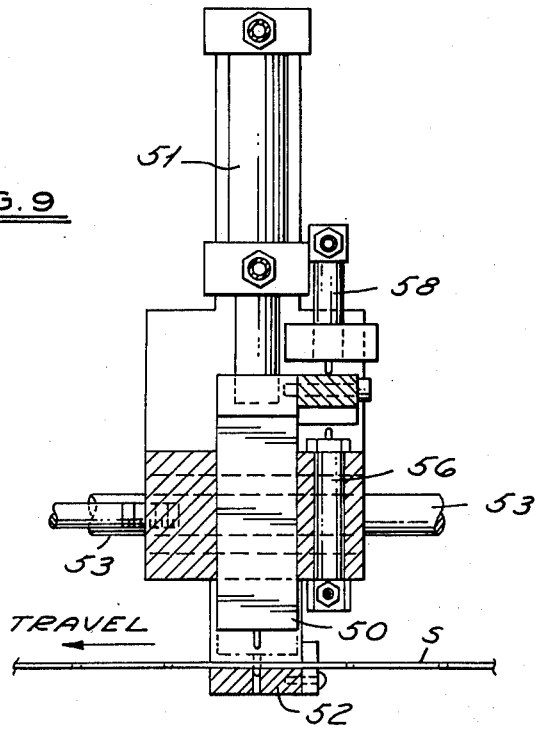
FIG. 9 is a fragmentary sectional view taken along the line 9—9 in FIG. 8.
Figure 10:
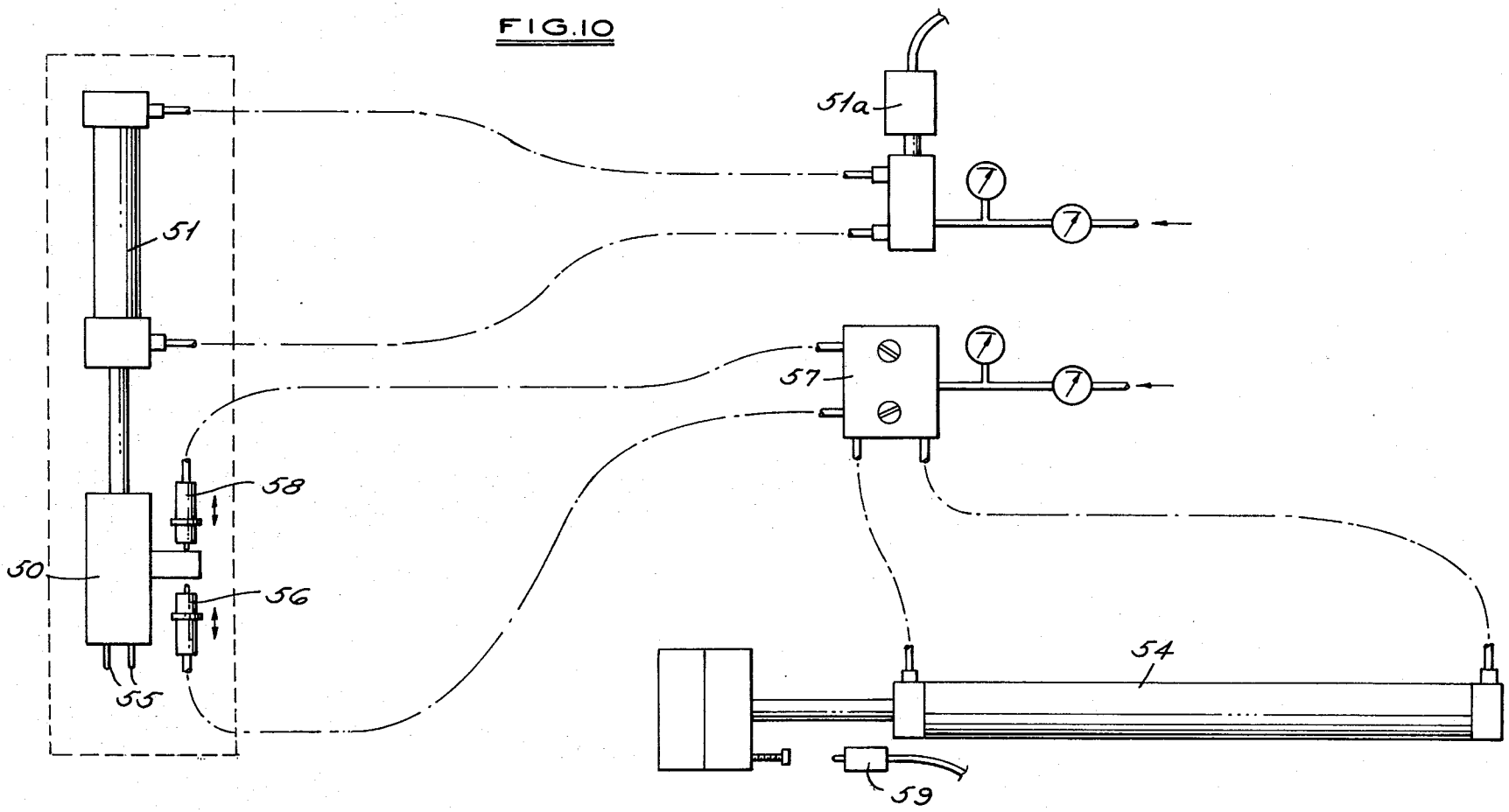
FIG. 10 is a schematic view of the pneumatic circuit for controlling the portion of the apparatus for feeding the strip longitudinally.

Referring to FIGS. 5, 6, 8–10, the apparatus for intermittently gripping and moving the strip through the plating station comprises a clamping member 50 that is movable by an air cylinder 51 under control of a solenoid controlled valve 51*a* toward and away from a clampimg member 52 to grip the strip S (FIG. 8). The entire assembly of the gripping members is movable longitudinally along the spaced rods by a cylinder 54.

In order to insure proper registry, sensing pins 55 are associated with the movable member 50 and are adapted to engage the openings O in the strip S. In the event that the sensing pins do not engage the openings O, a pilot sensor 56 (FIG. 10) is not actuated and, in turn, prevents operation of the four-way air valve 57 that applies air to the air cylinder 54. If the pins do engage the openings O, then the sensor 56 is properly actuated to permit operation of the valve 57. A second pilot sensor 58 is associated with the upward movement of the movable member 50 to permit the valve 57 to provide an appropriate signal to cause a return of the gripping members to their original longitudinal position after the grip on the strip S is released. A limit switch 59 is provided at the end of the stroke of members 50, 52 which is actuated to initiate movement of the plating heads and release of the members 50, 52 so that a plating cycle will immediately begin.

As indicated in associaton with FIG. 1, in the electroplating process, it is necessary to move the strip S through various tanks for cleaning, rinsing and the like.

Figure 11:
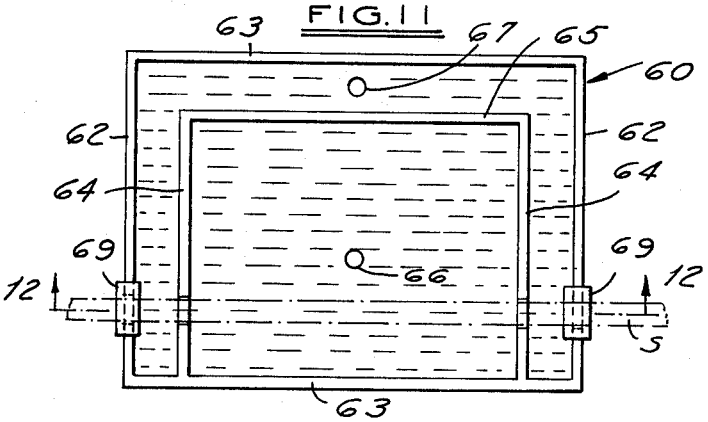
FIG. 11 is a fragmentary plan view of a solution tank for treating the strip.
Figure 13:
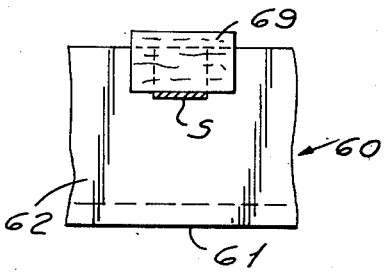
FIG. 13 is a fragmentary side elevational view on an enlarged scale of the tank shown in FIG. 11.
Figure 12:
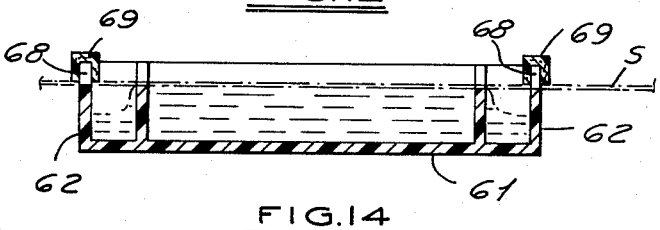
FIG. 12 is a sectional view taken along the line 12—12 in FIG. 11.

In accordance with the invention, as shown in FIGS. 11–13, one such tank 60 comprises a bottom wall 61, spaced end walls 62 and side walls 63. The tank further includes inner walls 64 spaced from the end walls 62 and an inner side wall 65 spaced from one side wall 63. The tank further includes an inlet 66 and an outlet 67 in the bottom wall. The walls 62, 64 are provided with aligned notches 68 through which the strip S passes and thereby is subjected to the continuously moving or changing solution in the tank. Hold-downs 69 in the form of plastic members having a U-shaped cross section engage the upper edges of the walls 62 to retain and hold the strip downwardly in the solution without adversely affecting the strip.

Figure 15:
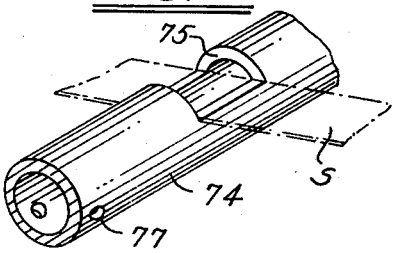
FIG. 15 is a fragmentary perspective view on an enlarged scale of a portion of the tank shown in FIG. 14.
Figure 14:
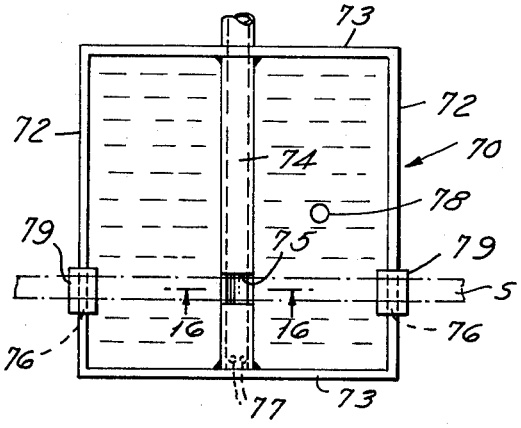
FIG. 14 is a fragmentary plan view of another form of solution treating tank.
Figure 16:
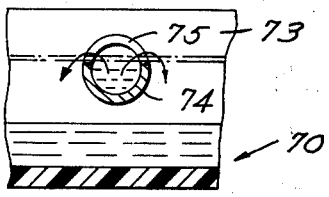
FIG. 16 is a fragmentary sectional view taken along the line 16—16 in FIG. 14.
Figure 17:
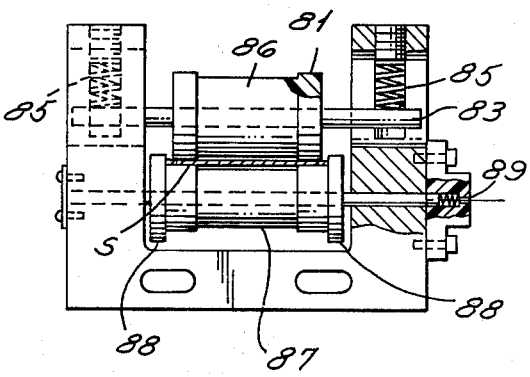
FIG. 17 is a part sectional view of a frictional roller assembly utilized in the apparatus.
Figure 18:
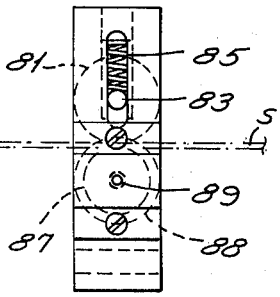
FIG. 18 is a side elevational view of the same.

Another type of tank 70 is shown in FIGS. 14–16 and comprises a bottom wall 71, end walls 72, and side walls 73. The inlet in tank 70 comprises a tube 74 that extends through one side wall 73 into engagement and abutment with the other side wall. The tube is formed with a notch 75. The notch 75 is aligned with notches 76 in the end wall 72 so that the strip passes through the notches 75, 76. Fluid entering the tank through the pipe 74 passes outwardly through the notch 75, thoroughly rinsing the work strip as it passes through, as well as openings 77 in the end of the tube which is closed against the other side wall 73 and the liquid then flows outwardly through an outlet 78 in the bottom wall 71. A hold-down 79 similar to hold-down 69 is associated with each notch 76 and functions to maintain the strip S in the notches 76.

As previously indicated in association with FIG. 1, friction rollers are provided at points F1, F2, F3 and F4 along the path and function to retain the strip against longitudinal movement except when the motor 22 or the apparatus 24 are functioning.

Each of these pairs of rollers comprises a resilient roller 81 and a complementary metal roller 82 mounted on shafts 83, 84, respectively. The shaft 83 is yieldingly urged downwardly against the roller by spaced springs 84. The center portions 86, 87 of the rollers 81, 82 are cut away to minimize the contact with the strip S. In addition, the lower roller 82 includes an end flange 88 which guides the strip S. By this arrangement, the strip S is frictionally held and prevented from moving longitudinally except when it is subjected to a positive longitudinal force. The roller mechanism has the further advantage in that through the shaft 84 an electrical lead can be provided as at 89 so that the electrical circuit can be complated at stations such as F2, F3 or at rollers associated with tanks where electrical power may be used for providing the current that is necessary for electroplating and the like.

I claim:

1. An apparatus for electroplating selected portions of a strip comprising means for intermittently moving the strip through successive stations, means at one of said stations for selectively electroplating selected portions of the strip, said last-mentioned means comprising upper and lower press members, means for moving said press members relative to one another toward and away from one another, an upper mask of resilient material on said upper member, a lower mask of resilient material on said lower member, said lower mask having a plurality of openings therein having the configuration of the selected portion which is to be plated, said mask engaging and gripping said strip when said upper and lower members are moved toward one another, said lower member having a plurality of openings therein, said lower member having a first chamber therein, an outlet from said first chamber, said openings in said lower member having their lower ends chamfered and extending to said first chamber, a plurality of tubes mounted in said first chamber and having their upper ends extending into the chamfered portions of the openings in said lower member, said lower member having a second chamber and an inlet to said second chamber, means providing communication between said second chamber and the interior of said tubes such that electroplating solution may be passed through said inlet to said second chamber and, in turn, through each of said tubes to direct electroplating solution against the underside of the exposed selected portions of the strip, said solution thereafter passing along said chamfered portions to said first chamber and to the outlets.

2. The combination set forth in claim 1 including means for frictionally engaging and holding said strip in registry with the selected openings in said lower mask and providing an electrical contact to said strip.

3. The combination set forth in claim 2 wherein said means for intermittently moving said strip comprises a reciprocating gripping means alternately engaging and moving said strip for a predetermined distance in one direction.

4. The combination set forth in claim 3 including means responsive to engagement with selected openings in said strip, said means being associated with said gripping means and operable when there is a lack of registry to interrupt the movement of said gripping means.

5. The combination set forth in claim 2 wherein said means for frictionally engaging said strip comprises friction rolls, said rolls being made of resilient material and having portions thereof cut away to minimize the application of pressure to the longitudinal edges of the strip.

6. The combination set forth in claim 1 wherein said lower member has a removable plate forming said openings with chamfered portions such that said plate and mask can be removed and replaced with a mask and plate having selective portions with different configurations.

7. The combination set forth in claim 1 wherein each of said tubes is axially adjustable with respect to the openings into which the upper end of the tube extends.

8. The combination set forth in claim 1 wherein said upper and lower member is made of three parts including a first block and a plate defining said first chamber, a distributor block removably mounted in said first block and supporting said tubes, a lower block defining said second chamber, said means providing communication between said second chamber and said tubes comprising an elongated slot in said first block.

9. The combination set forth in claim 8 including means surrounding said lower member and defining a collecting tank.

10. The combination set forth in claim 1 including at least one solution treating tank comprising a bottom and sides for retaining treating solution, an inlet, an outlet, said sides having notches therein for guiding said strip through said solution, said tank having internal walls spaced longitudinally of the strip inwardly of said peripheral walls and having notches therein aligned with the notches in the peripheral walls.

11. The combination set forth in claim 10 including means engaging the peripheral walls and applying a force on said strips to retain said strips in said notches.

12. The combination set forth in claim 11 wherein said last-mentioned means comprises thermoplastic members.

13. The combination set forth in claim 12 wherein said members have a U-shaped cross section for engaging the upper edge of the peripheral wall.

14. The combination set forth in claim 10 wherein said internal walls are defined by a tube comprising the inlet.

15. An apparatus for electroplating selected portions of a strip comprising means for intermittently moving the strip through successive stations, means at one of said stations for selectively electroplating selected portions of the strip, at least one solution treating tank comprising a bottom and sides for retaining treating solution, an inlet, an outlet, said sides having notches therein for guiding said strip through said solution, said tank having internal walls spaced longitudinally of the strip inwardly of said peripheral walls and having notches therin aligned with the notches in the peripheral walls.

16. The combination set forth in claim 15 including means engaging the peripheral walls and applying a force on said strips to retain said strips in said notches.

17. The combination set forth in claim 16 wherein said last-mentioned means comprises thermoplastic members.

18. The combination set forth in claim 17 wherein said members have a U-shaped cross section for engaging the upper edge of the peripheral wall.

19. The combination set forth in claim 15 wherein said internal walls are defined by a tube comprising the inlet.

* * * * *